US006152777A

United States Patent [19]

Smith et al.

[11] Patent Number: 6,152,777

[45] Date of Patent: Nov. 28, 2000

[54] CARD EDGE CONNECTOR WITH MOVABLE KEY

[75] Inventors: Scott Stuart Smith, Dallas, Tex.; Robert Thomas Hirsbrunner, Hummelstown; Karen Elizabeth Benjamin, Harrisburg, both of Pa.

[73] Assignee: The Whitaker Corporation, Wilmington, Del.

[21] Appl. No.: 09/291,963

[22] Filed: Apr. 15, 1999

[51] Int. Cl.[7] ..... H01R 24/00

[52] U.S. Cl. ..... 439/633; 200/506

[58] Field of Search ..... 439/593, 633, 439/681, 189; 200/43.04, 506

[56] References Cited

U.S. PATENT DOCUMENTS

| | | | |
|---|---|---|---|
| 2,935,725 | 5/1960 | Fox | 439/633 |
| 3,573,711 | 4/1971 | Henschen | 439/593 |
| 4,927,787 | 5/1990 | Patel | 439/189 |
| 6,017,248 | 1/2000 | Pan et al. | 439/681 |

OTHER PUBLICATIONS

AMP Instruction Sheet No. 7479, Insertion/Extraction Tools; Mar. 1976; 2 pages; AMP Incorporated, Harrisburg, PA.

Peripheral Component Interconnect, AMP article; Copyright 1993; AMP Incorporated, Harrisburg, PA.

AMP Instruction Sheet No. 7498, Twin Leaf Mother–Daughter Connectors; Mar. 1976; 4 pages; AMP Incorporated, Harrisburg, PA.

*Primary Examiner*—Neil Abrams
*Assistant Examiner*—Michael C. Zarroli

[57] ABSTRACT

Connector 10 mountable to a mother board for mating with a daughter card (80,90) at a card-receiving slot (14). Connector (10) includes at least two key-receiving sites (30*a*, 30*b*) along the length of the card-receiving slot (14), and a pair of switching contacts (40) at each site that are normally in engagement with each other, completing an indicator circuit of the mother board. A key member (50) is affixable to the connector at a selected one of the key-receiving sites (30*a*,30*b*) and includes an actuator arm (58) that disengages the switching contacts (40), breaking the circuit. The key member (50) prevents insertion of a daughter card (90) that is not programmed by having a notch (82) at the corresponding location.

18 Claims, 8 Drawing Sheets

CARD EDGE CONNECTOR WITH MOVABLE KEY

FIELD OF THE INVENTION

This is related to the field of electrical connectors and more particularly to card edge connectors.

BACKGROUND OF THE INVENTION

Card edge connectors are known that are mountable onto a circuit board ("mother board") and provide for receipt of an edge of another circuit board ("daughter card") into a card-receiving slot for contacts of the connector to become electrically connected to circuit pads on the card's surface adjacent the inserted end, for interconnecting those circuits to corresponding circuits of the mother board on which the connector is mounted. Presently multiple daughter cards are in commercial use for interconnection with the mother board, such as cards that are designed for operation at different voltage levels, and presently different connectors are needed for mating therewith to establish the interconnections.

It is desirable to provide a single connector that is matable with more than one type of circuit card.

SUMMARY OF THE INVENTION

The present invention is a card edge connector that includes a plurality of key-receiving sites, optionally along the card-receiving face, for receipt into at least one thereof of a key member. A pair of switching contacts at each site include board-connecting sections that are connected to circuits of the mother board, and include contact sections that have a first state wherein they are in electrical engagement with each other to define a closed indicator circuit, and in a second state wherein they are disengaged, breaking the circuit. The key member includes an actuator arm that engages the switching contacts to change the state of the switching contacts at the selected key-receiving site.

In one embodiment, the key member includes a pair of latch arms that depend from a horizontal strut, to latch the key member to the housing. The switching contacts are affixed within the housing at each site, and may be aligned with the card-receiving slot but vertically lower than the slot bottom. The actuator arm of the key member depends from the strut to descend into the card-receiving slot and therepast to change the switching contacts from one state to the other, such as deflecting them apart to disengage the switching contacts that normally are engaged.

In another embodiment, the key includes a connector portion that would extend alongside the card edge connector when the key is affixed at a key-receiving site, so that the connector portion would shunt a pair of contacts within a separate board-mounted header beside the key-receiving site of the card edge connector.

In yet another embodiment, the key is secured to the connector but movable along rails between key-receiving sites. In still another embodiment, an insert includes a key at one end for one key-receiving site, and an actuator at the other end for switching the contacts of the other key-receiving site.

An embodiment of the present invention will now be described by way of example with reference to the accompanying drawings, in which:

BRIEF DESCRIPTION OF THE INVENTION

Figure 12:
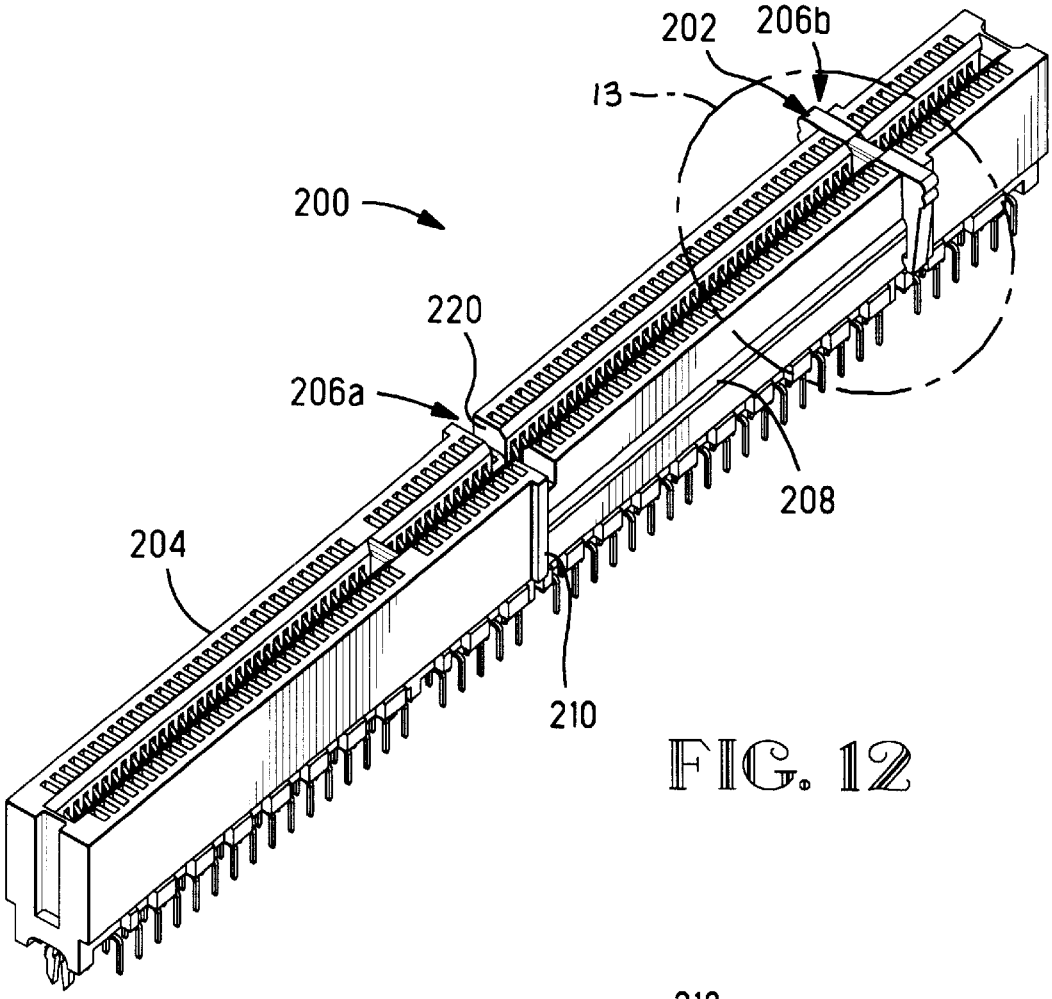
Figure 13:
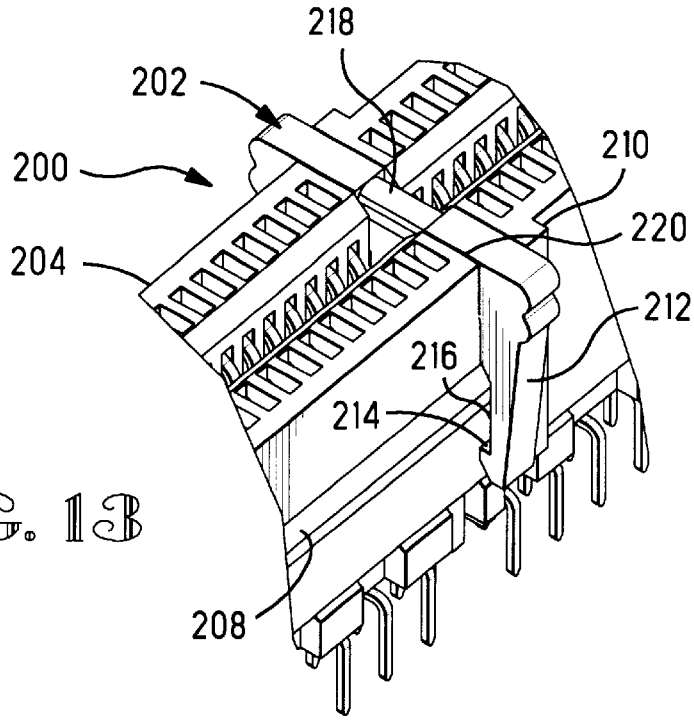
Figure 14:
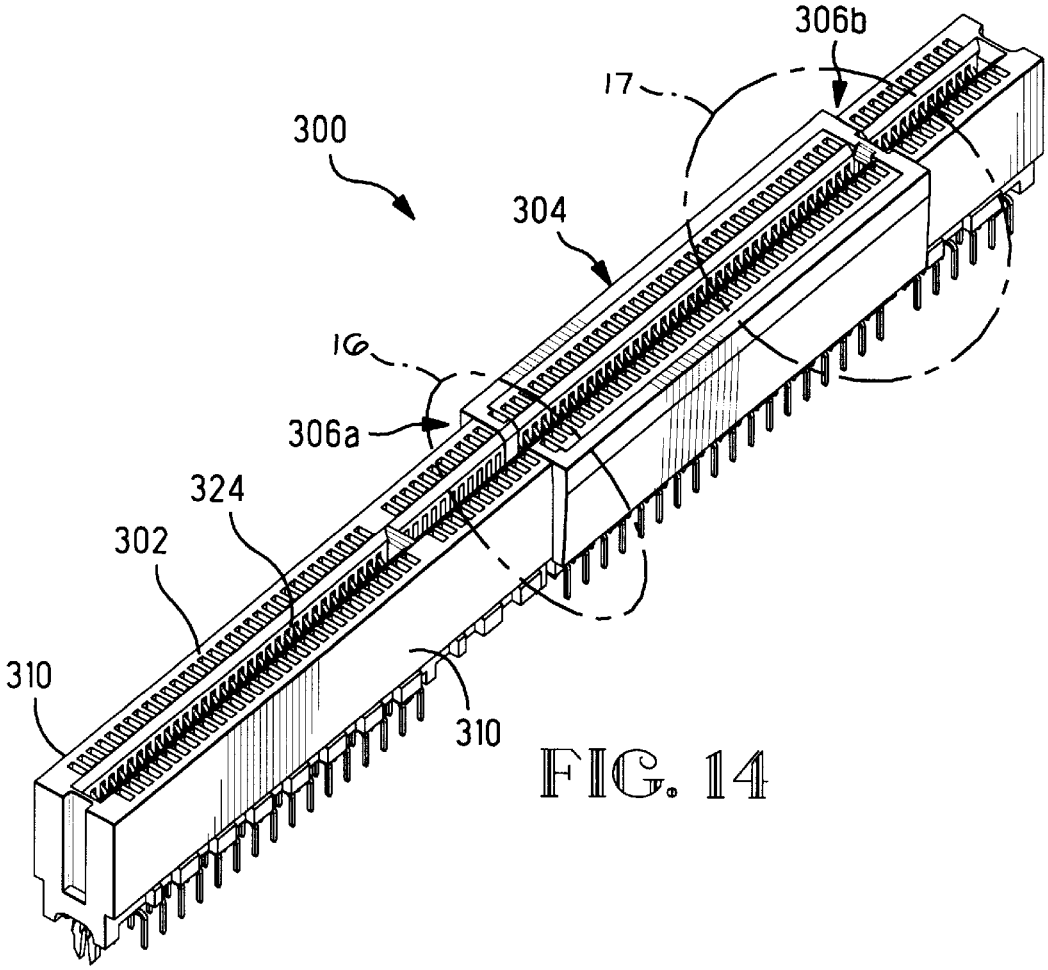
Figure 15:
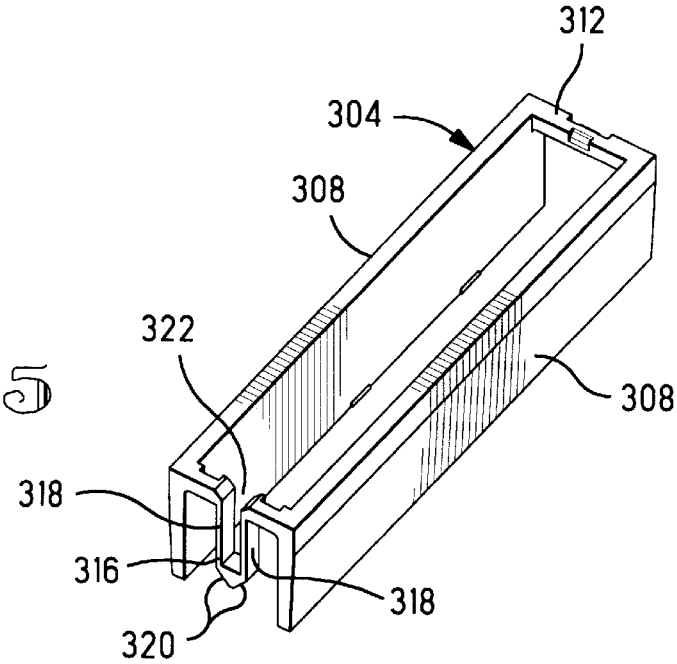
Figure 16:
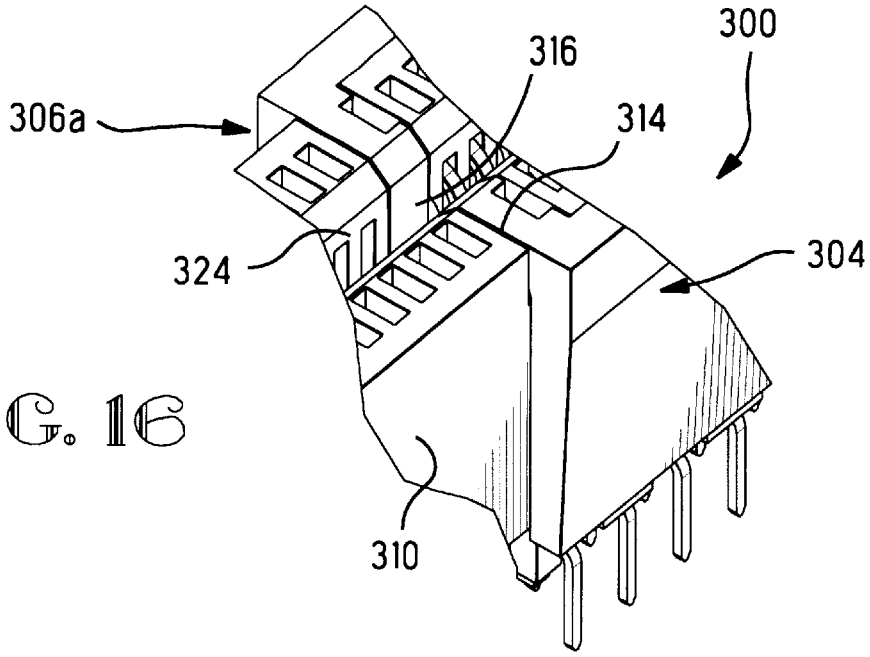
Figure 17:
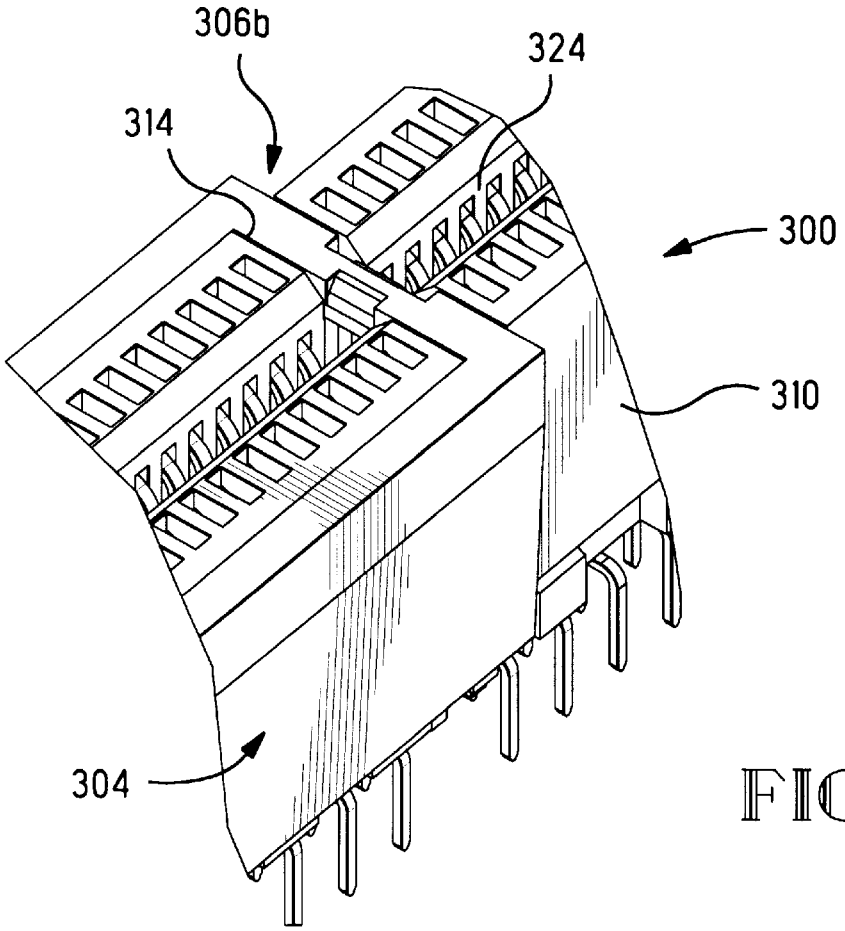

FIGS. 12 and 13 illustrate a third embodiment of switching arrangement with a single key member movable along rails between key-receiving sites; and FIGS. 14 to 17 show a third embodiment of switching arrangement with an insert affixed to the connector and extending between key-receiving sites, with a key member at one end for one key-receiving site and an actuator at the other end for switching the contacts at the other key-receiving site.

DETAILED DESCRIPTION

Figure 1:
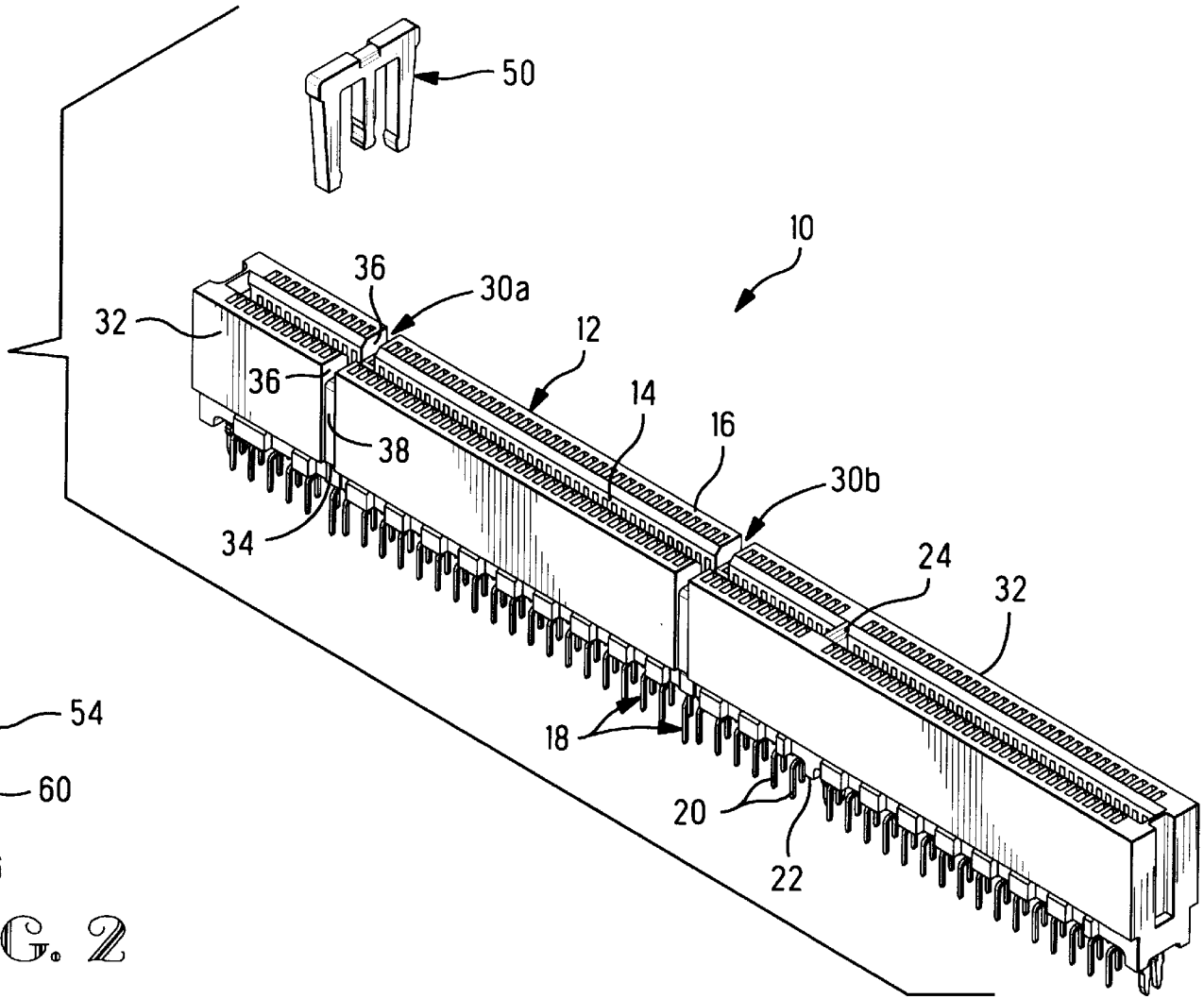
FIG. 1 is an isometric view of the connector of the present invention.
Figure 2:
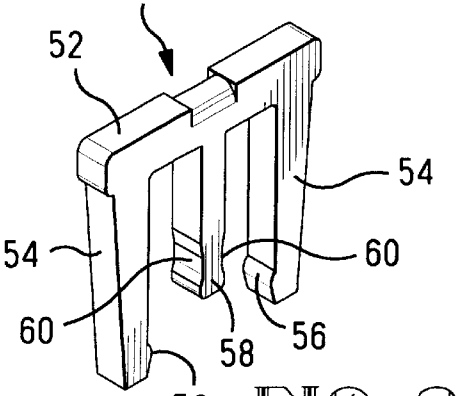
FIG. 2 is an isometric view of a key of the present invention.
Figure 3:
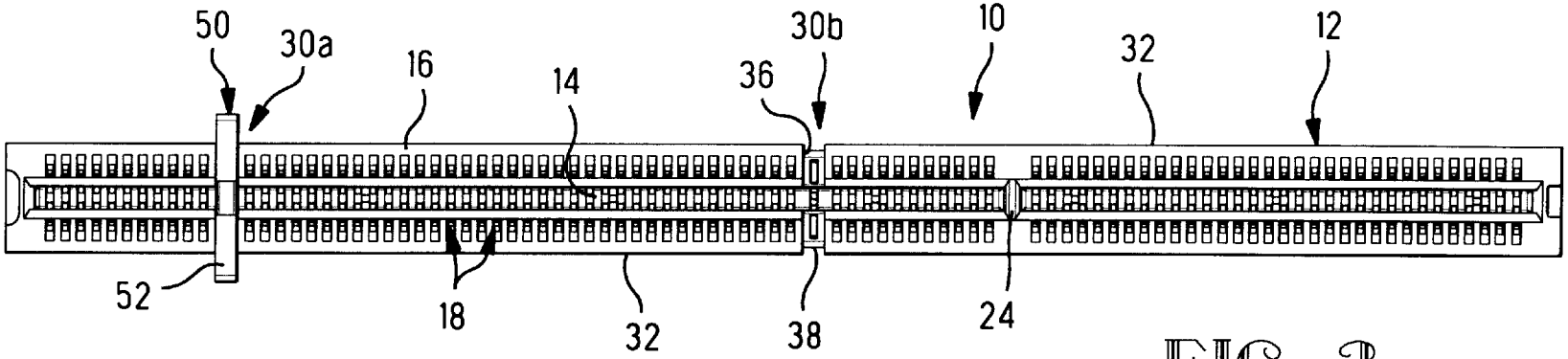
FIGS. 3 and 4 are top and elevation views of the connector of FIG. 1 showing a key of FIG. 2 in one of the several possible key-receiving sites.
Figure 4:
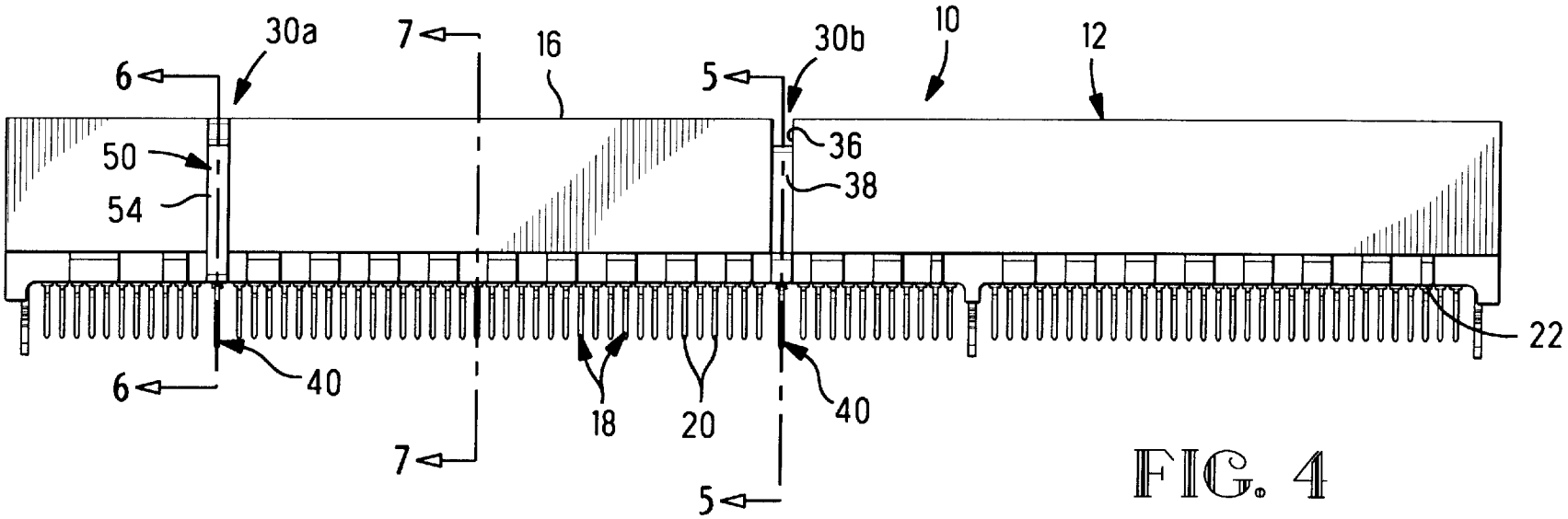
Figure 7:
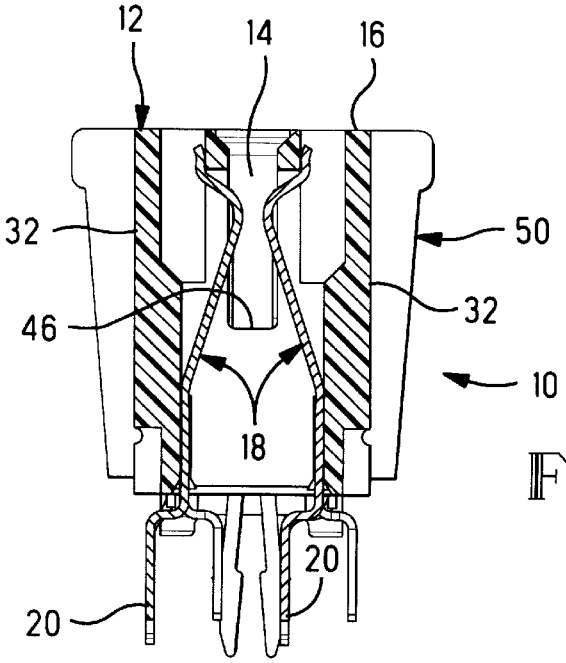

Connector 10 of FIG. 1 is seen to include a housing 12 of insulative material, a card-receiving slot 14 defined in the card-receiving face 16 along the length thereof, and pairs of contacts 18 along the card-receiving slot for engaging associated circuit pads of a daughter card (FIGS. 7 or 8) when the card is fully received into slot 14. Contacts 18 include board-connecting sections 20 that depend from board-mounting face 22. A permanent key 24 is defined by a wall segment traversing the card-receiving slot 14 at a selected location therealong, that is received into a corresponding key way or notch of the card, that is at a standardized location on all cards with which the connector of the present invention is to be used.

At several locations along the length of connector 10 are defined key-receiving sites 30*a*,30*b*. Each key-receiving site is adapted to receive a key 50 (FIGS. 1 to 5) affixable to the housing 12 optionally in a manner permitting removal thereof. Horizontal strut 52 of key 50 traverses card-receiving slot 14 when the key is in its latched position at a key-receiving site 30*a*,30*b*, and is received into a corresponding notch 82 in the card edge of the appropriate card 80 (FIG. 7) to permit full insertion and mating of the card with connector 10. Once a key 50 has been positioned at key-receiving site 30*a* to program the connector for insertion of a selected card 80 (FIG. 7), a card 90 that is not intended to be mated (FIG. 8) with thus-programmed connector 10 is not notched at the same location, and key 50 would prevent full insertion and mating of such a card.

Key 50 includes a pair of elongate arms 54 depending from strut 52, that extend along respective outer side surfaces 32 of housing 12 and have latch projections 56 at free ends thereof to latch beneath ledges 34 proximate board-mounting face 22. Housing 12 preferably provides aligned horizontal recesses 36 in card-receiving face 16 that oppose each other across the card-receiving slot 14 within which strut 52 of key 50 is seated. Also, housing 12 provides shallow channels 38 along outer side surfaces 32 within which elongate key arms 54 partially seat in the latched position.

Figure 5:
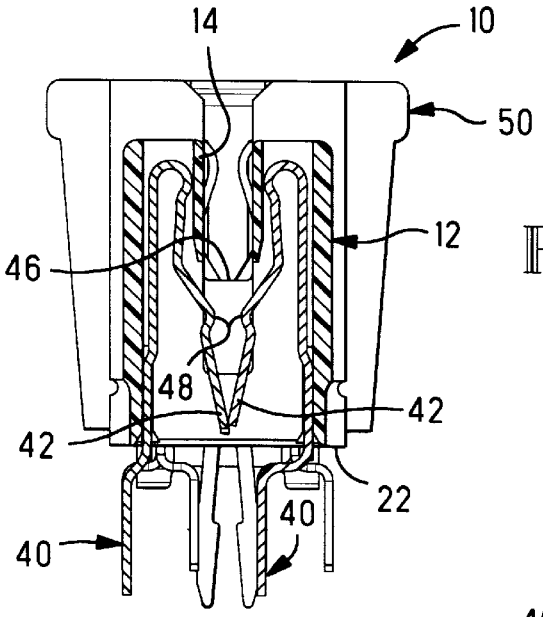
FIGS. 5 to 7 are cross-sectional views taken at lines 5—5, 6—6 and 7—7 of FIG. 4 illustrating, respectively, a key-receiving site with switching contacts in engagement, the key separating the pair of contacts at a key-receiving site, and a pair of contacts that are not at a site.
Figure 6:
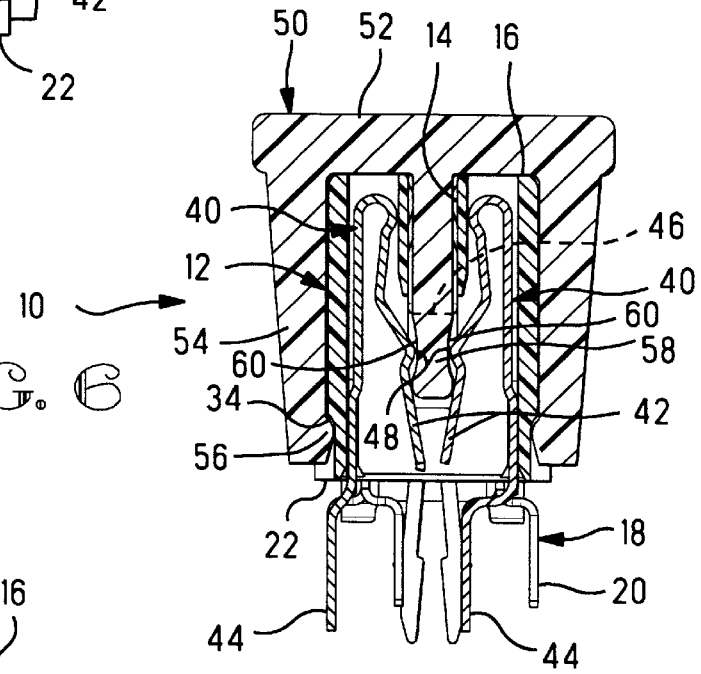

With reference to FIG. 5, housing 12 includes a pair of switching contacts 40 at each key-receiving site 30*a*,30*b* that have contact sections preferably in the form of deflectable spring contact arms 42 that are electrically engaged in a first position and disengaged in a second position. In the embodiment herein disclosed in FIGS. 1 to 9, they normally are in spring-biased electrical engagement with each other. Switching contacts 40 include board-connecting contact sections 44 that depend from board-mounting face 22 of housing 12 to be connected to an indicator circuit of the mother board (not shown). As seen in FIG. 6, key 50 includes an actuator arm 58 depending centrally from strut 52 to reach deeply into card-receiving slot 14 when key 50 is in its latched position. Actuator arm 58 engages both switching contacts 40 to change them from one position to the other. In the embodiment shown in FIGS. 5 and 6, the actuator arm deflects them apart disrupting the electrical engagement thus breaking the indicator circuit on the mother board at that key-receiving site. It may be seen that switching contacts engage each other at a vertical location that is lower than the bottom 46 of card-receiving slot 14, and cannot be deflected into the disengaged position by the edge of a card fully inserted into slot 14.

Preferably, actuator arm 58 includes a pair of detents 60 adjacent the leading end, into which are received embossments 48 of switching contacts 40, thus assisting in retaining key member 50 affixed to the connector.

Figure 8:
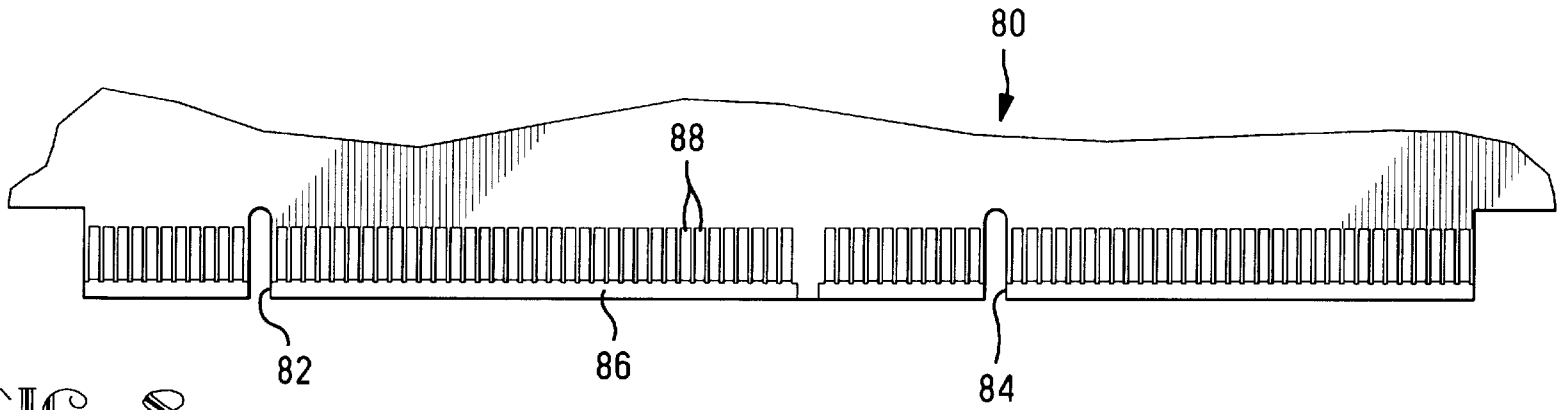
FIGS. 8 and 9 illustrate edges of two cards with which the connector of the present invention is used.

In FIG. 8 is shown an edge portion 86 of daughter card 80 having circuit pads 88 therealong, having a notch 82 at a relative left position extending inwardly from leading edge 86 thereof, as well as notch 84 that is associated with wall segment or permanent key 24 of connector 10. Card 80 will mate with connector 10 when key 50 is positioned at the relative left key-receiving site 30*a*, but will be blocked if a key were at the relative central key-receiving site 30*b*.

Figure 9:
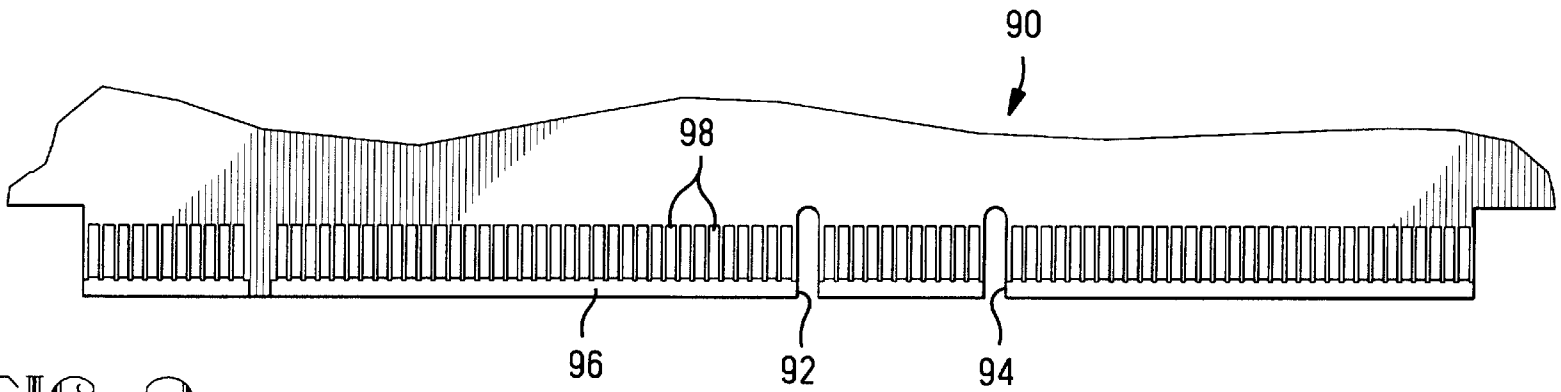

In FIG. 9 is an edge portion 96 of daughter card 90 with circuit pads 98 and having a notch 92 at a relative central position, as well as notch 94 for permanent key 24. Card 90 will not mate with connector 10 if key 50 is in the relative left key-receiving site 30*a*, but will enter card-receiving slot 14 for mating if key 50 were positioned at the relative central key-receiving site 30*b*.

The present invention is useful, for example, where the type of card for which mating with a particularly keyed connector 10 is desired, could be operable at a voltage level of 3.3 volts (card 80 of FIG. 8), whereas the other card could be operable at a voltage level of 5 volts (card 90 of FIG. 9), and the indicator circuit of the mother board provides for the mother board to know the appropriate voltage level of the card that is mated with connector 10.

Figure 10:
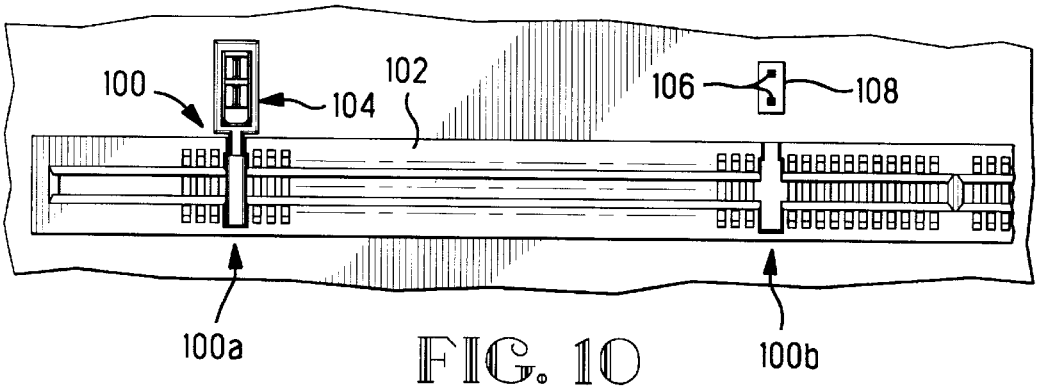
FIGS. 10 and 11 show an alternate embodiment of switching arrangement with the key having a connector portion alongside the card edge connector, matable with a board-mounted connector to shunt the contacts thereof when affixed at a key-receiving site.
Figure 11:
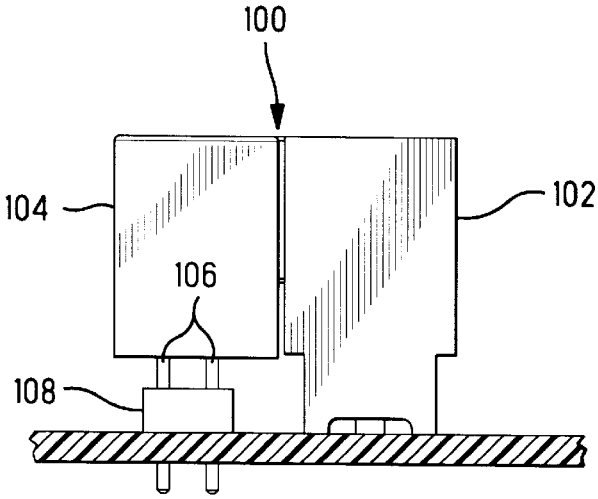

An alternative arrangement of the invention is shown in FIGS. 10 and 11. A key member 100 for a connector 102 includes a shunting connector portion 104 that includes a contact therewithin that provides a pair of contact sections matable with a pair of contacts 106 of a board-mounted header connector 108 located beside connector 102 at each key-receiving site 110*a*,110*b*. In this embodiment, the pair of contacts 106 are switching contacts that are normally disengaged from each other in the absence of a key, and are electrically connected or shunted by the contact of shunting connector portion 104 when the key member 100 is mounted at the key-receiving site.

In FIGS. 12 and 13, a connector 200 has a key member 202 and a housing 204 having two key-receiving sites 206*a*,206*b*, where the housing includes rails 208 defined on and along outer housing surfaces between the key-receiving sites, and further includes ribs 210 traversing rails 208 defining stops just beyond each site. Key member includes legs 212 with latches 214 at ends thereof to latch beneath rails 208, with legs 212 providing recesses 216 above latches 214 for rails 208 such that key member 202 is adapted to be raised for transverse body section 218 to be elevated out of slot 220 of the housing at one key-receiving site, with latches 214 still disposed beneath rails 208 so that key member 202 is still attached to the housing, and then slid along housing 204 to the other key-receiving site and then inserted into position thereat.

Connector 300 of FIGS. 14 to 17 includes a housing 302 and an insert 304 comprising a key member, that spans the length of housing 302 between key-receiving sites 306*a*, 306*b*. Insert 304 includes a pair of walls 308 that extend along outer surfaces 310 of housing 302 when affixed into position. At one end of insert 304 is a transverse strut 312 defining a key portion associated with a notch of a card, that is received into a strut-receiving slot 314 of the housing at one key-receiving site. At the other end of insert 304 is an actuator 316 that extends into the housing at the other key-receiving site, to disengage the switching contacts at that site. Actuator 316 joins the insert walls 308 at the insert end and is defined by a pair of leg portions 318 joined at bottom ends 320, the leg portions being separated above the bottom ends by a gap 322 that mimics the card-receiving slot 324 of the housing so that a card edge without a corresponding notch thereat is receivable thereinto. Preferably the housing provides channels in side walls of the card-receiving slot 324 beneath strut-receiving slot 314 thereat for leg portions 318 to be recessed thereinto upon insertion. Insert 304 can be removed and reversed in orientation, if desired.

Variations and modifications can be made to the specific embodiments disclosed herein, that are within the spirit of the invention and the scope of the claims. For example, more than two key-receiving sites may be provided on a connector, where more than two types of daughter cards are available for use with the connector. Also, the cards could be distinct from each other other than by having different voltage levels. Further, the key could be securable to the housing in a different manner than disclosed, or have an actuator that is adapted to engage switching contacts that otherwise remain disengaged. The keys may be fabricated of a color different than that of the connector housing. In another variation, two (or more) keys differing in geometry could be swapped between two (or more) key sites and correspond to different cooperable structures (such as notches) of different cards.

What is claimed is:

1. A card edge connector, comprising:

a housing having a card-receiving face and a board-mounting face and opposed outer side surfaces, said card-receiving face including a card-receiving slot thereinto extending to a slot bottom, and a plurality of contacts disposed within said housing along said card-receiving slot for electrical engagement with circuit pads of an edge portion of a circuit card inserted into said card-receiving slot, at least two key-receiving sites and a pair of switching contacts associated with each said key-receiving site, said switching contacts including contact sections that in a first position are in engagement with each other in a second position are disengaged from each other, and said switching contacts further include board-connecting sections that are electrically connected to an indicator circuit of a mother board to which the connector is mounted whereby the circuit is closed when said switching contacts are in said first position, and a key member affixable to said housing at a selected one of said at least two key-receiving sites, said key member including an actuator section that upon affixing said key member to said housing, interacts with said switching contacts associated with a said key-receiving site and moves said contact sections thereof from one of said first positions to an other of said first and second positions, whereby the state of the indicator circuit of the mother board is changed.

2. The connector as set forth in claim 1 wherein said key-receiving sites are arranged along said card-receiving face associated with respective locations along said card-receiving slot.

3. The connector as set forth in claim 1 wherein said switching contacts are disposed outside of said housing, and said key member has a connector portion to cooperate electrically with said switching contacts.

4. The connector as set forth in claim 3 wherein said switching contacts are normally not engaged, and said key connector portion causes engagement.

5. The connector as set forth in claim 1 wherein said switching contacts are disposed within said housing and all portions of said switching contacts remain outside said card-receiving slot and are free from engagement by said card.

6. The connector as set forth in claim 5 wherein said contact sections of said switching contacts are spring arms that engage each other at a vertical location that is lower than a bottom of said card-receiving slot.

7. The connector as set forth in claim 6 wherein said actuator arm includes detents at a contact-engaging portion thereof, and said switching contacts include protrusions that seat within said detents upon affixing of said key member to said connector at said key-receiving site.

8. The connector as set forth in claim 1 wherein cooperation of said switching contacts with said key member assists in retention of said key member to said connector.

9. The connector as set forth in claim 1 wherein said key member includes latch sections that latch to the housing upon full insertion into said key-receiving site.

10. The connector as set forth in claim 9 wherein said latch sections are defined at ends of elongate latch arms that extend along said outer side surfaces of said housing to latch beneath ledges proximate said board-mounting face.

11. The connector as set forth in claim 10 wherein said housing includes vertical channels along said outer side surfaces within which said latch arms seat.

12. The connector as set forth in claim 1 wherein said housing cooperates with said key member to at least partially retain said key member to said housing while permitting movement between ones of said key-receiving site.

13. The connector as set forth in claim 12 wherein said housing includes rails along outer surfaces thereof and extend between at least two said key-receiving sites, said key member includes legs that extend downwardly along said housing outer surfaces for latch sections thereon to latch beneath said rails upon at least partial insertion of said key member into one of said key-receiving sites, and said legs include recesses above said latch sections that permit said key member to be raised to remove a transverse section from a slot of said housing for moving said key member along said housing to an other said key-receiving site while remaining attached to said housing.

14. The connector as set forth in claim 1 wherein said key member includes a strut that traverses said card-receiving slot when affixed at said key-receiving site, and said actuator arm depends from said strut and into said card-receiving slot.

15. The connector as set forth in claim 14 wherein said housing includes opposed recesses into said card-receiving face at each said key-receiving site, into which is received said strut of said key member.

16. The connector as set forth in claim 14 wherein said switching contacts at a respective said key-receiving site are in said first position when said key member is absent, and said actuator section engages said contacts and deflects them apart to said second position, breaking said indicator circuit associated with said key-receiving site when said key member is affixed to said housing at said key-receiving site.

17. The connector as set forth in claim 1 wherein said key member is a one-piece insert having side walls to extend along outer surfaces of said housing between a pair of key-receiving sites, said key member including a transverse section at one end that traverses said card-receiving slot at one said key-receiving site, and said key member including an actuator at least at an opposed end that is insertable into said housing at a respective said key-receiving site to cooperate with switching contacts thereat to move them from said first position to said second position.

18. The connector as set forth in claim 17 wherein said actuator comprises a pair of leg portions that extend into said housing along sides of said card-receiving slot at said other key-receiving site to bottom ends that are joined together, and said leg portions are spaced apart thereabove by a gap that mimics said card-receiving slot for a portion of a card edge to be inserted into said gap.

* * * * *